US006598616B2

(12) United States Patent
Nutsos

(10) Patent No.: US 6,598,616 B2
(45) Date of Patent: Jul. 29, 2003

(54) TAPPING POINT AND SUPPLY WATER NETWORK COMPRISING SUCH TAPPING POINT

(76) Inventor: Mikael Nutsos, Önnemovägen 73, S-146 33 Tullinge (SE)

( * ) Notice: Subject to any disclaimer, the term of this patent is extended or adjusted under 35 U.S.C. 154(b) by 0 days.

(21) Appl. No.: 09/910,774

(22) Filed: Jul. 24, 2001

(65) Prior Publication Data

US 2003/0019530 A1 Jan. 30, 2003

(51) Int. Cl.[7] ..... E03C 1/02

(52) U.S. Cl. ..... 137/337; 137/517; 137/533; 137/597

(58) Field of Search ..... 137/337, 517, 137/563, 597; 126/362

(56) References Cited

U.S. PATENT DOCUMENTS 4,738,280 A * 4/1988 Oberholtzer ..... 122/13.3
5,421,362 A * 6/1995 Sordello ..... 137/334
5,459,890 A * 10/1995 Jarocki ..... 122/13.3
5,709,546 A 1/1998 Waggoner
5,851,388 A 12/1998 Suh
5,891,329 A 4/1999 Massholder
5,942,125 A 8/1999 Engelhard et al.
6,021,803 A 2/2000 Nutsos
6,027,572 A 2/2000 Labib et al.

* cited by examiner

*Primary Examiner*—Stephen M. Hepperle
(74) *Attorney, Agent, or Firm*—Burns, Doane, Swecker & Mathis, LLP

(57) ABSTRACT

A water tapping point with a hot water inlet; a cold water inlet, a hot water space, a cold water space, a mixing chamber, a hot water outlet from the hot water space and a cold water outlet from the cold water space. A characteristic feature of the invention is passage means extending between the hot water outlet and the cold water outlet and provided with means for connection to a common return water pipe. The invention also relates to a tap water network comprising a plurality of tapping points. The tap water network needs only one return water pipe.

11 Claims, 6 Drawing Sheets

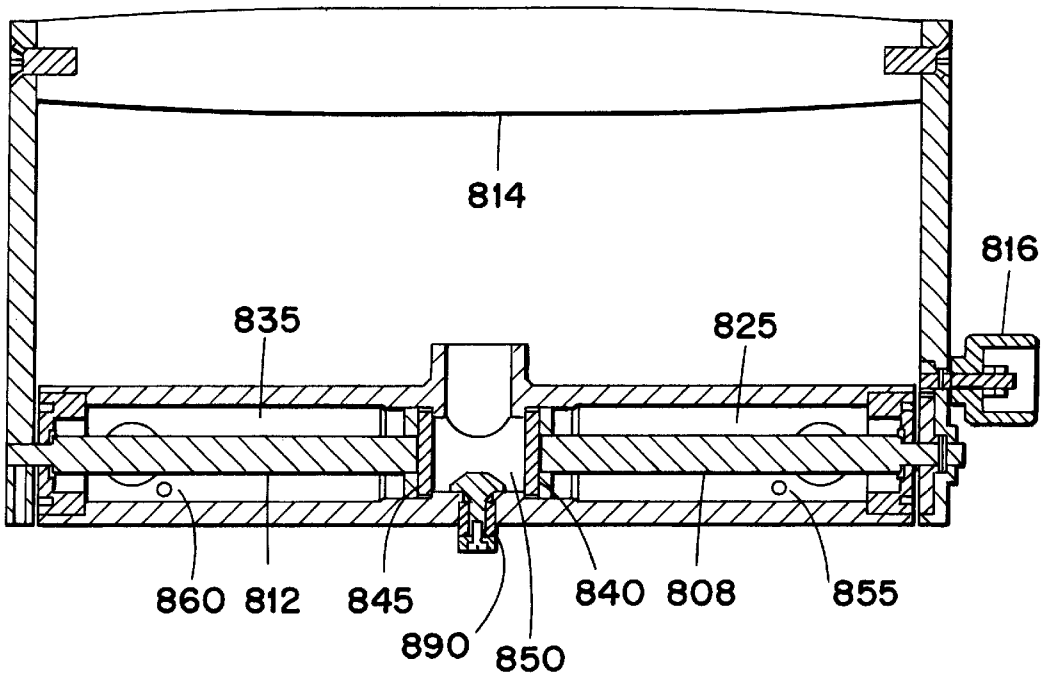
Fig. 8
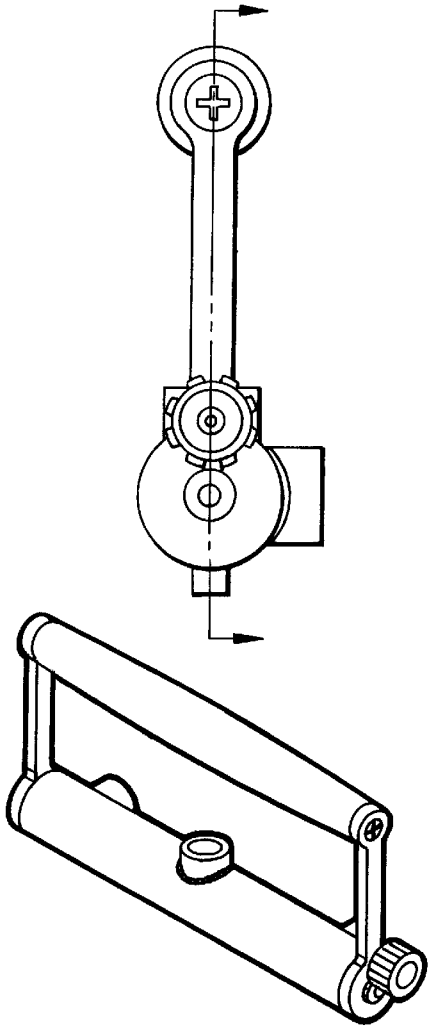

TAPPING POINT AND SUPPLY WATER NETWORK COMPRISING SUCH TAPPING POINT

The present invention relates to a water tapping point and a tap water network effectively impeding bacterial growth, in particular, legionella bacteria growth, in the water tapping point as well as in the water network.

BACKGROUND OF THE INVENTION

One problem of known tapping points is that especially the hot water space and the mixing chamber constitute an environment for the growth of water-borne bacteria, especially the feared legionella bacteria that can increase in numbers up to 10,000-fold within 48 hours if the water temperature is about 35° C. The legionella bacterium does circulate in water as a free-living organism, and is also a part of a very complex micro-environment that is found, for example, on the inside of water tanks, water pipes and mixers. The biofilm, which there consists of micro-organisms, becomes a thin layer of slime and is surprisingly resistant to influences such as biocides used specifically for the purposes of combating the growth of the bacteria. A biocide may effectively kill all free-living bacteria in the water, but the bacteria in the biofilm will often survive and start to multiply in the water as soon as the conditions allow it. This capability of "hiding" makes certain bacteria e.g. legionella very difficult to effectively control. The problem is increasing, supposedly related to the more widespread use of modern apparatuses having spaces with stagnant water allowed to cool down or warm up to the hazardous temperature region of 25–50° C. A typical example of such apparatus and a potential source of legionella bacteria being modem thermostatic mixers. Bacterial growth is considered to cease at temperatures above 50° C.

Recent attempts to address this problem have included mixers where an operator can use a special tool to temporarily flush the mixer and the water supply system with scalding hot water for several minutes with the aim of killing the bacteria during a round of all the tapping points in a hospital or care establishment, for example. A computer-controlled automated system for the regular flushing of mixers with hot water has also been suggested. Further experience has shown sanitizing effects are achieved by continuously supplying the water with oxidising biocides such as chlorine, bromine or ozone. Flushing methods are taught in e.g. U.S. Pat. No. 6,027,572 and references therein. However, all such procedures imply a great deal of manual labor and consequently costs for the service operator in, for example, a hospital. In addition, the activities in the clinics will be disrupted.

Other attempts of addressing the bacteria problem is by purifying the water in, or close to, the tapping device. Methods and devices include adding ozone (U.S. Pat. No. 5,942,125), using multiple filters (U.S. Pat. No. 5,851,388), adding bactericidal agent through a pumping device (U.S. Pat. No. 5,709,546) and sterilization by UV radiation (U.S. Pat. No. 5,891,329). Although effective in certain applications e.g. in dental units, their complexity and need for maintenance make them less suitable for large-scale installation such as every tapping device in a hospital or an apartment building. Also the principle of purifying water at a late stage and not addressing the problem of the rapid growth of bacteria could be questioned.

In a recently granted U.S. Pat. No. 6,021,803, by the same applicant as in the present invention the problem of legionella bacteria is addressed by providing a tapping point including a mixer for hot and cold water, with a hot water and a cold water inlet, and a hot water and a cold water space. To impede the growth of especially legionella bacteria within the mixer it is suggested that the mixer additionally is provided with a hot water outlet from the hot water space of the mixer. The outlet is connected to a hot water return pipe and through an arrangement of valves the hot water is always kept under circulation. This will assure that the water will not cool down to the hazardous temperature region 25–50° C. Thermally insulated return pipes for hot water are, in fact, often already installed in the water mains network of a building, whereby in such cases, the return pipes only need to be furnished with branches off to the respective tapping point. This will keep the installation and maintenance cost at a reasonable level. U.S. Pat. No. 6,021,803 is incorporated by reference herein.

Traditionally legionella and other bacteria have been considered to be a problem mainly in systems with heated water. Recently attention has been drawn also to the cold water systems. If the cold water is kept immovable for a long period it could heat up to the dangerous temperature region 25–50° C., for example during a hot summer day. Another potential risk is that the cold water system is heated by the hot water system. For example in a common thermostatic mixer the cold water spaces can be heated through thermal conduction from the hot water parts. Similarly warming up through thermal conduction could occur if the hot and cold water pipes are poorly isolated and too close to each other. At temperatures below 18° C. legionella growth is known to be very limited. To the best knowledge of the inventor no prior art tapping points are designed to limit the heat transfer between hot and cold parts.

In U.S. Pat. No. 6,021,803 it is suggested that the cold water is circulated in the same manner as the hot water. This would be an effective way of limiting the bacteria growth, but it would require a return system also for the cold water. In addition a cooling system would be needed in order to avoid continuously warming up the water. Return pipes for cold water do normally not exist in the mains, nor equipment for cooling the water. This system would in many cases be too complicated and expensive, especially if installed in existing buildings.

To summarize the requirements to keep legionella growth at minimum: The hot water should be hot at all times, and the cold water should be cold at all times and spaces with immovable water should be carefully avoided. To keep the investments and the maintenance cost at reasonable levels the system must not require a complete new backbone network of water mains or tapping points requiring frequent maintenance. None of the prior art fulfills these requirements.

SUMMARY OF THE INVENTION

In conventional tap water networks the water is, in certain spaces, allowed to warm up or cool down to temperature regions hazardous for bacterial growth. Known solutions for solving this problem are costly to install, or require frequent maintenance.

One object of the present invention is to overcome the drawbacks of the prior art by providing a tap water network that effectively impedes bacterial growth in all parts of the network.

Another object is to provide providing a tap water network that effectively impede bacterial growth at reasonable installation and maintenance costs.

In order to achieve the above-mentioned objects, according to the invention, a tapping point is provided that allows continuous circulation of hot water in its hot water parts and continuous circulation of cold water in its cold water parts.

The inventive tapping point gives the possibility to construct a water network with constant circulation of hot and cold water in all parts of the network. Any parts not suitable to circulate with hot or cold water are evacuated and ventilated.

A realization of the above-mentioned objects, according to one aspect of the invention, is a tapping point comprising a hot water inlet; a cold water inlet, a hot water space; a cold water space, a mixing chamber, a hot water outlet from the hot water space and a cold water outlet from the cold water space, providing a flow of hot return water from the hot water outlet and a flow of cold return water from the cold water outlet. An advantage with this arrangement is that the cold water always circulates and therefore remains cold in the cold water space and the warm water always circulates and therefore remains warm in the hot water space. This will effectively impede bacterial growth. In addition convenience is added for the user as cold and hot water will always be present when starting to use the tapping point.

The flow of return water from the hot water outlet and the flow of return water from the cold water outlet are combined into a common flow of return water. In doing so circulation of both the hot water and the cold water is achieved without the need of a separate cold water return network. The common flow of return water is thus arranged to flow in a common return water pipe.

According to one preferred embodiment of the invention the water tapping point comprises a hot water inlet; a cold water inlet, a hot water space, a cold water space, a mixing chamber; a hot water outlet from the hot water space and a cold water outlet from the cold water space. The hot water outlet from the hot water space and the cold water outlet from the cold water space are combined, by passage means, into a common return water outlet, the latter being adapted for connection to a common return water pipe.

According to another embodiment of the invention the hot water outlet and the cold water outlet are provided with adjustment valves to control the flow and temperature of the return water. The adjustment valves are typically set once so that the common flow of return water gives a desired flow at a desired temperature which preferably is above 50° C.

According to yet another embodiment of the invention the mixing chamber is provided with a pressure sensitive valve, said valve arranged to open when the tapping point is not in use in order to drain and ventilate the mixing chamber and preferably also any equipment connected to the mixer chamber such as a shower hose, for example.

BRIEF DESCRIPTION OF THE DRAWINGS

The invention will now be described in detail with reference to the drawing figures, in which

FIG. 8 is a longitudinal cross sectional view of a water tap point realised in the form of a mixer in accordance with a third embodiment of the invention.

RELATED ART

Figure 1:
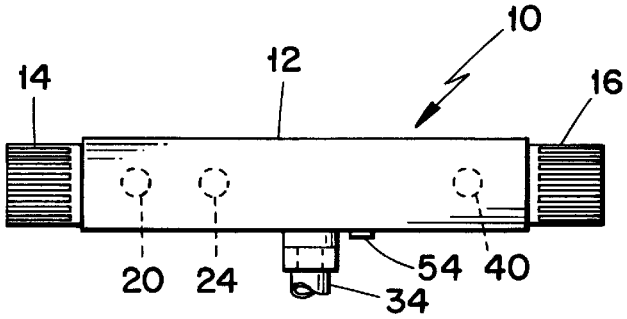
Fig. 1 (Prior Art)
FIG. 1 is a front view of a prior art tapping point.

A prior art mixer and mixer housing will be described briefly with reference to FIGS. 1–3. The mixer 10 include a mixer housing 12 with a hot water inlet 20, a cold water inlet 40 and a mixer outlet 34 leading to a basin, bath or similar 80. The flow and temperature of the water that emerges from the mixer are adjusted by the knobs 14 and 16 respectively. The schematic representations in FIGS. 1*b* and 1*c* show the principle of the mixer's 10 functional characteristics according to U.S. Pat. No. 6,021,803. At one end of the mixer housing 12, the hot water inlet 20, in connection with a hot water pipe 64, opens into a hot water space 22 that can occupy a larger or a smaller portion of the interior of the mixer housing 12. There is a piping passageway 28 and an inlet valve 30 between the hot water space 22 and a mixing chamber 32. At the other, opposite end of the mixer housing 12, the cold water inlet 40, in connection with a cold water pipe 70, opens in an equivalent manner, into a cold water space 42 that can occupy a larger or a smaller portion of the interior of the mixer housing 12. There is a piping passageway 48 and an inlet valve 50 between the cold water space 42 and the mixing chamber 32. There is an outlet-valve 36 between the mixing chamber 32 and the mixer outlet 34.

Figure 2:
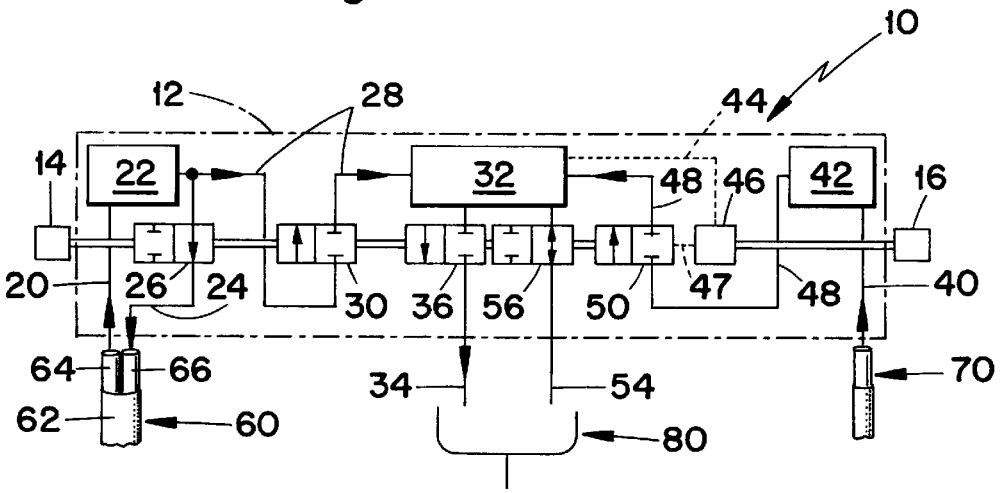
Fig. 2 (Prior Art)
FIG. 2 is a schematic view of the tapping point in FIG. 1 in a closed position.
Figure 3:
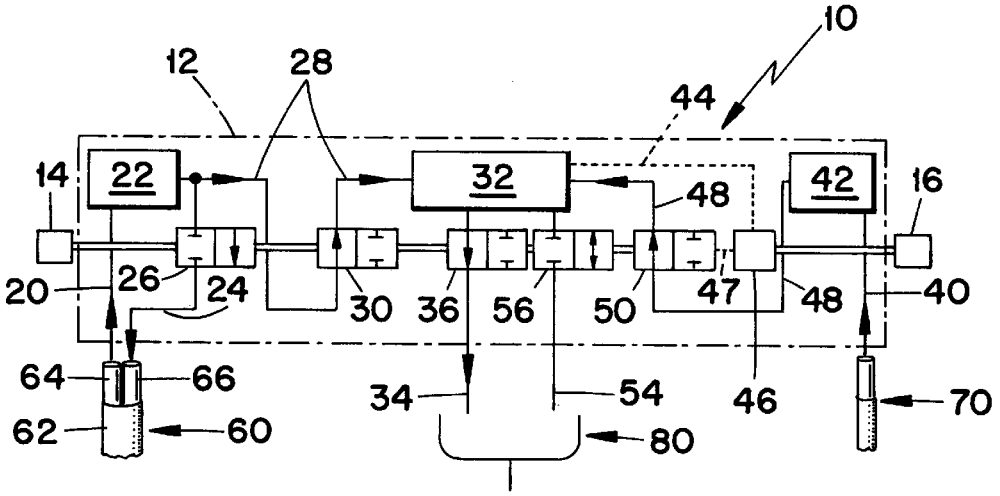
Fig. 3 (Prior Art)
FIG. 3 is a schematic view of the tapping point in FIG. 1 in an open position.

The inlet valves 30, 50 and the outlet valve 36 are, as indicated in FIGS. 2 and 3, mechanically connected to one another so that they can be adjusted when a user turns knob 14 to open the mixer to the position shown in FIG. 3, or to close the mixer to the position shown in FIG. 2. The temperature of the mixed water that emerges from the mixing chamber 32 is adjusted with the knob 16 that regulates the mutual opening positions of valves 30 and 50 for setting the desired temperature of the mixed water. Knob 16 is additionally connected to a thermostat 46 that is capable of comparing the desired set temperature with the actual temperature via a pipe 44 and that, using feedback via a schematically represented transfer device 47, adjusts the said mutual opening positions in accordance with this desire by what is, in fact, a known mechanism.

According to said U.S. patent the mixer 12 also has a hot water outlet 24 from the hot water space 22. The hot water outlet 24 is arranged to be connected with a return pipe 66 for hot water via an outlet valve 26. As indicated in FIG. 2 and 3, outlet valve 26 is arranged to be adjusted together with other valves by maneuvering knob 14. Outlet valve 26 is open in the closed mixer position (FIG. 2) and closed in the open mixer position (FIG. 3) so as to the hot water space is continuously flushed with hot water when the mixer is not in use.

A drainage and ventilation outlet 54 extends from the mixer chamber 32. This is opened and closed by a valve 56, which is manoeuvred together with the other valves by turning knob 14. More specifically, valve 56 is arranged so that it is closed during the open mixing position (FIG. 3) and open during the closed mixing position (FIG. 2). If the mixer has two alternative outlets, such as a conventional pipe and a shower hose, both of these can be drained and ventilated via the outlet 54. To further reduce the risk of bacterial growth in the mixer chamber 32, said chamber is preferably constructed with a minimal volume.

As suggested in U.S. Pat. No. 6,021,803 also the cold water space 42 can be equipped with a water outlet, preferably through a valve like the hot water outlet valve 26, and connected to a return pipe. Every tapping point will accordingly need to be served with one hot water pipe, one cold water pipe, one hot water return pipe and one cold water return pipe.

Figure 4:
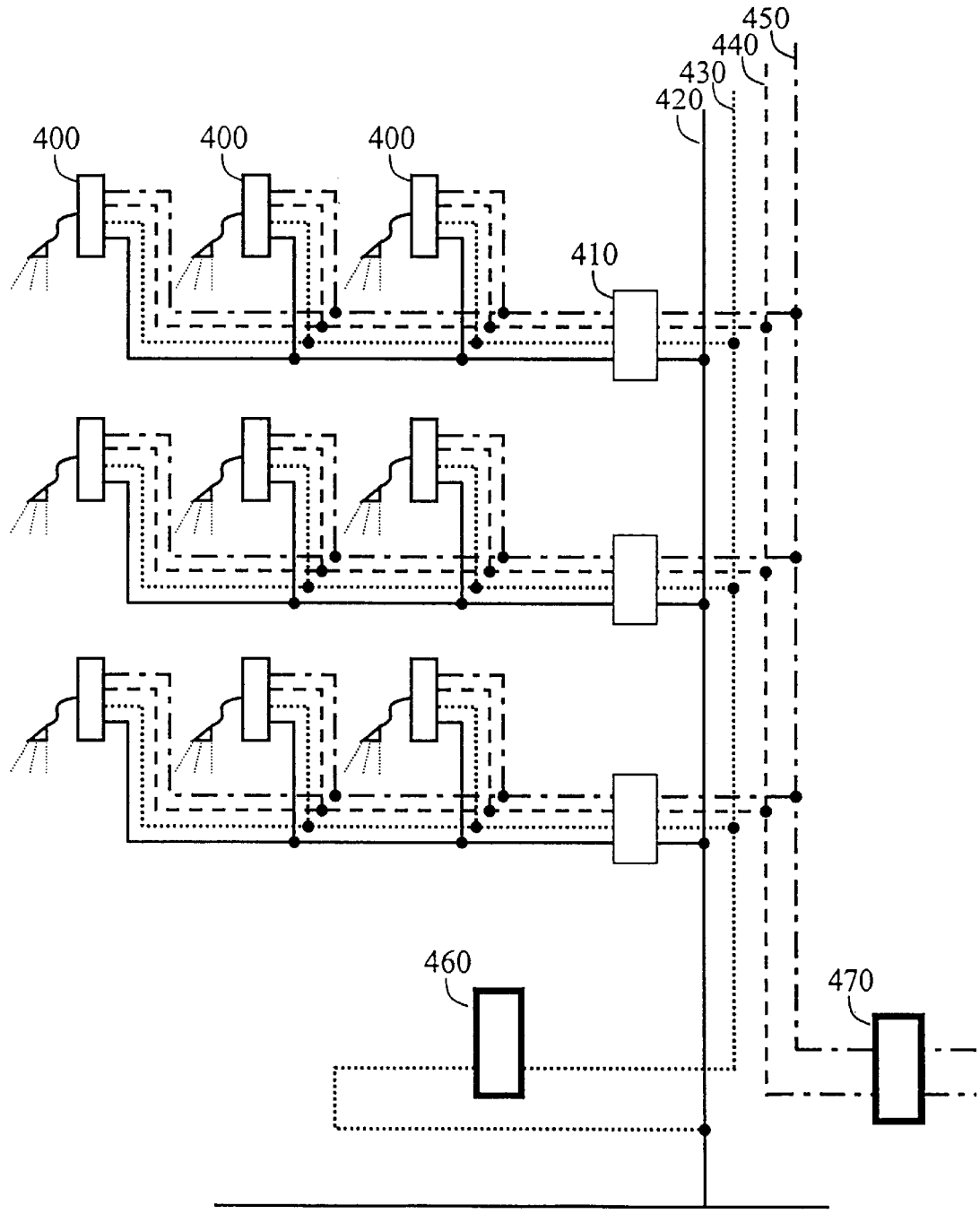
Fig. 4 (Prior Art)
FIG. 4 is a schematic view of a prior art water supply system.

The corresponding tap water system is schematically illustrated in FIG. 4. The water mains network, comprising of a least one pipe for hot water 450, one hot water return pipe 440, one cold water pipe 420 and one cold water return pipe 430 is branched off, typically at each floor of a building, via pressure controlled regulators 410 and fed to the individual tapping points 400, here illustrated by the above-described thermostatic shower mixers. The return cold water is kept cold by a cooling device 460 and the hot water by heating device 470.

DETAILED DESCRIPTION OF THE INVENTION

Figure 5:
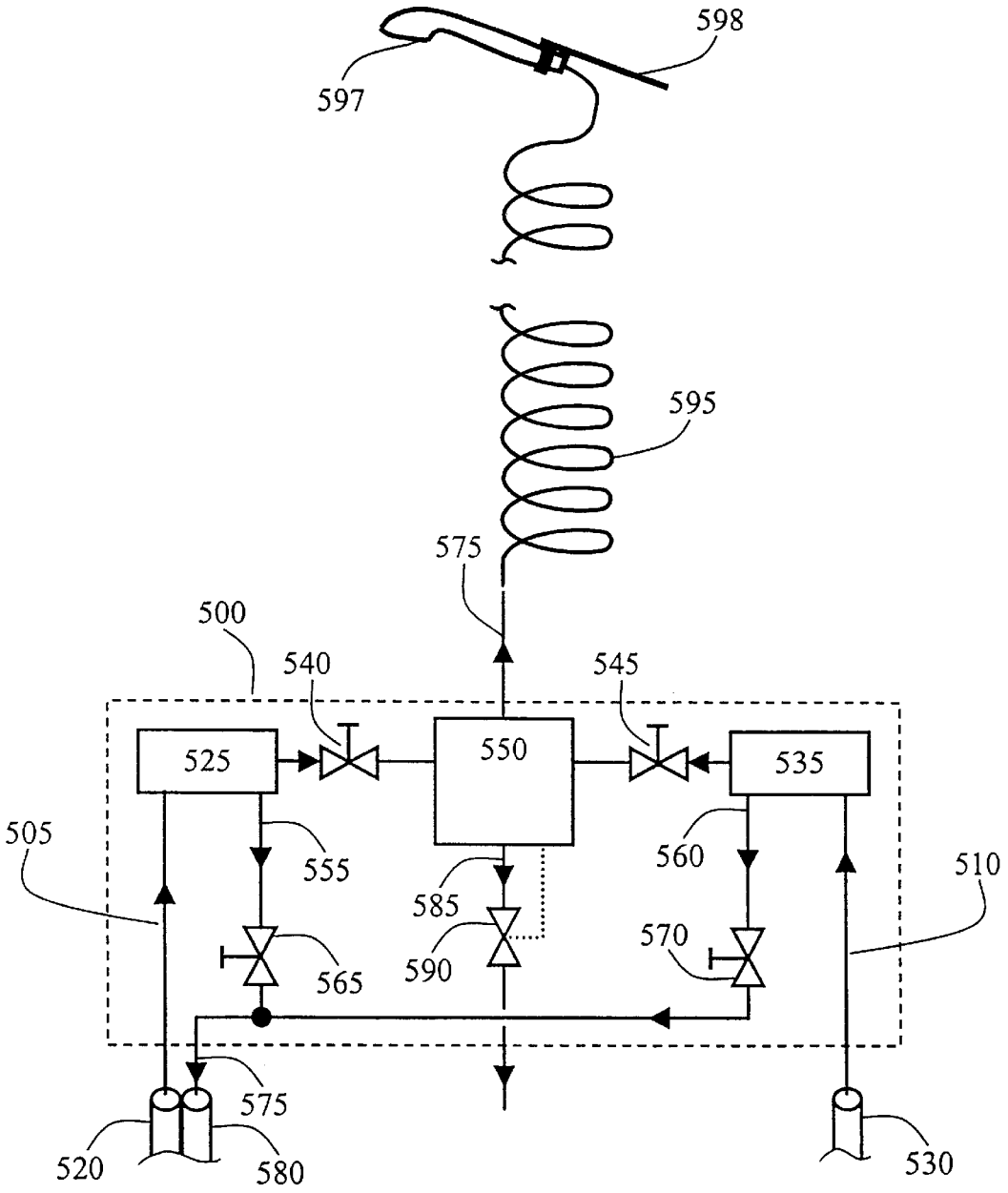
FIG. 5 is a schematic view of a water tap point according to the present invention.

Turning now to a first embodiment of the present invention, described with reference to the schematic illustration of FIG. 5. The mixer, comprising a mixer housing 500, a hot water inlet 505, a cold water inlet 510 and a mixed water outlet 515 leading to a shower, for example. The hot water inlet 505 is connected to a hot water pipe 520 and leads to a hot water space 525. Similarly the cold water inlet 510 is connected to cold water pipe 530 and cold water space 535. The hot water space 525 and cold water space 535 are via valves 540 and 545, respectively, connected to a mixer chamber 550. The valves 540 and 545 are operated separately, or are mechanically coupled to each other in a "single-lever" arrangement, and may incorporate thermostatic devices through e.g., arrangements previously described with reference to the prior art mixer of FIG. 2. To achieve circulation in both the hot and the cold water parts the hot water space is equipped with a hot water outlet 555 and the cold water space with a cold water outlet 560. The hot water outlet 555 and the cold water outlet 560 are via adjustment valves 565 and 570, respectively, joined in a common return water outlet 575 and connected to a common return water pipe 580. The purpose of adjustment vales 565 and 570 is to set proper flows of the hot and cold return water and hence also the temperature of the return water. The adjustment valves 565 and 570 are typically adjusted at installation to give the desired flow and temperature, preferably above 50° C., of the water in the return pipe and are not adjusted during normal operation. This temperature is selected to impede bacterial growth as discussed above. By these arrangements the hot water parts of the tapping point will always experience a flow of hot water and the cold water parts always a flow of cold water. By combining the flows into one common return water outlet 575 only one return water pipe, the common return water pipe 580, is needed. As previously mentioned most larger buildings have hot return water pipes in the mains and common return water pipes from the individual tapping points are readily connected to an existing return water system.

The mixer chamber 550 is not subjected to circulating water when the mixer is not in use. Therefore, to minimize the risk of bacteria growth, the mixer chamber 550 is excavated through a drainage and ventilation outlet 585 via a valve 590. The valve 590 is preferably a pressure sensitive valve arranged to open when the pressure in the mixing chamber falls below a preset value. When both the inlet valves 540 and 545 have been maneuvered to a pressure sensitive valve arranged to open when the pressure in the mixing chamber falls below a preset value. When both the inlet valves 540 and 545 have been maneuvered to a closed position, i.e., when the mixer is no longer in use, the pressure will drop in the mixer chamber 550 and the valve 590 will open to drain the mixing chamber. Pressure sensitive valves with suitable characteristics are commercially available. Care has to be taken to also drain and ventilate the parts of the tapping point connected to the mixed water outlet 515. In FIG. 5 there is exemplified a hand held shower. A shower hose 595 is formed in a spiral shape e.g., with metallic reinforcements and extended by placing the hand shower 597 in a wall support 598 positioned so that the shower hose spiral will have a continuous downward directed curvature. This arrangement assures that no water will be trapped within the shower hose 595 or the hand shower 597 and all water will drain through drainage and ventilation outlet 585.

The invention has here been illustrated by discussing a simplified mixer showing only the for the principle functions necessary parts. Tapping points can indeed have a more complex construction with a larger plurality of valves, cold and hot water spaces and mixer chambers. Also the size and shape of such spaces can be varied in compliance with the design and/or the intended use of the tapping point. The hot and cold water spaces could be comprised in the hot and cold water inlets, for example. The skilled in the art, however, will appreciate that also other structures than the above illustrated can utilize the principles of the invention to achieve a circulation of hot and cold water and to drain, with the aid of pressure sensitive valves, any space not suitable for circulation.

Figure 6:
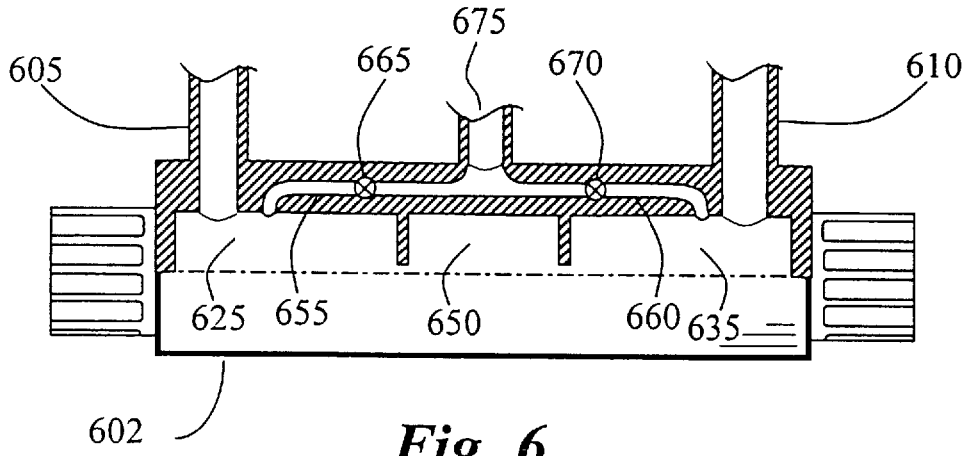
FIG. 6 is a partly longitudinal cross sectional view of a water tap point realised in the form of a mixer in accordance with a first embodiment of the invention.

In FIG. 6. an embodiment of the invention is illustrated. The hot water outlet 555 and the cold water outlet 560, of FIG. 5 are realized by passages 655 and 660, respectively, within the housing of the mixer and are connected to a common return water outlet 675 (corresponding to 575). As illustrated the passages 655 and 660 are provided in the wall of the mixer housing (602). Adjustment valves 665 (565) and 670 (570) are provided before the passages connect to the common return water outlet 675, and are made easily adjustable from outside the mixer housing. Shown in the figure are also a hot and cold water inlet, 605 and 610 respectively, and the hot and cold water space, 625 and 635 respectively and a mixing chamber (650).

Figure 7:
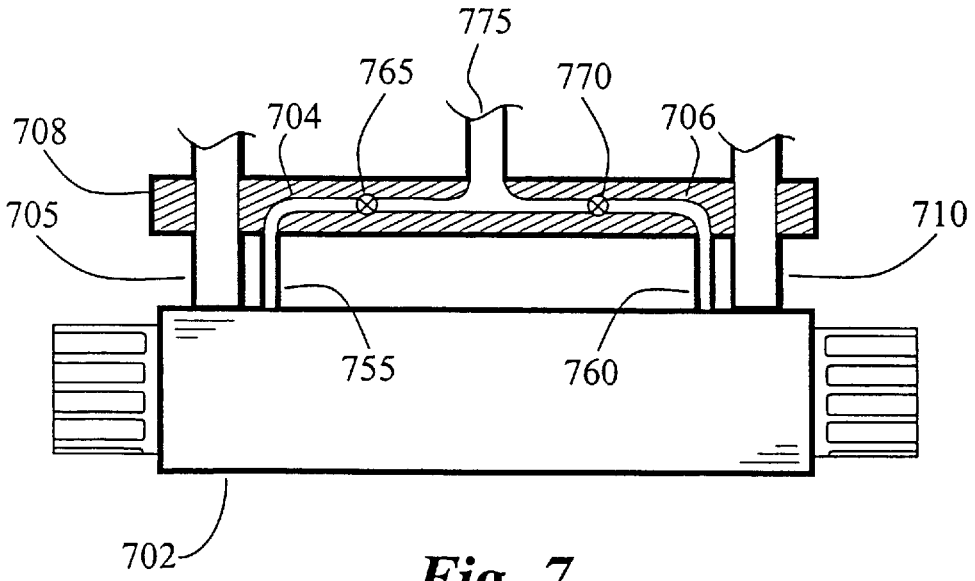
FIG. 7 is a partly longitudinal cross sectional view of a water tap point realised in the form of a mixer in accordance with a second embodiment of the invention.

FIG. 7. shows another embodiment of the present invention having the junction of the cold and hot water outlet placed outside of the mixer housing. The mixer 702 has separate outlets for the return hot water 755 and the return cold water 760. The return cold water and the return hot water are then led into an external device, comprising passages for hot and cold water, 704 and 706, respectively, preferably incorporated in a mixer wall support 708 as indicated in FIG. 7, and connected to a common return water outlet 775. The wall support can also include the adjustment valves 765 and 770. Shown in the figure are also a hot and cold water inlet, 705 and 710 respectively.

As discussed above cold parts of a mixer should be kept cold and hot parts kept hot. FIG. 8 illustrates an embodiment of the invention minimizing the heat transfer with two shafts 808 and 812. The shaft 808 is connected to the valve 840 controlling the flow of hot water from the hot water space 825 to the mixer chamber 850. The shaft 812 is connected to the valve 845 controlling the flow of cold water from the cold water space 835. The valves 840 and 845 are in mutual operation through the shafts 808 and 812 and the handle 814, preferably in a material of low thermal conductivity. The knob 816 adjusts the portion of hot water led into the mixer chamber 850. Indicated in the figure are the hot water outlet 855 and the cold water outlet 860 to allow circulation of hot and cold water and the drainage valve 890. By avoiding a through shaft and instead using a handle outside the actual mixer housing to couple the valve operations, the thermal transfer between the hot and cold parts of the mixer is reduced. By choosing materials in the mixer parts and housing with low thermal conductivity, e.g. plastic, the thermal transfer can be further reduced.

The water mains network, can by utilizing the invention, above exemplified with different embodiments, be significantly simplified in comparison with the network of FIG. 4.

Figure 9:
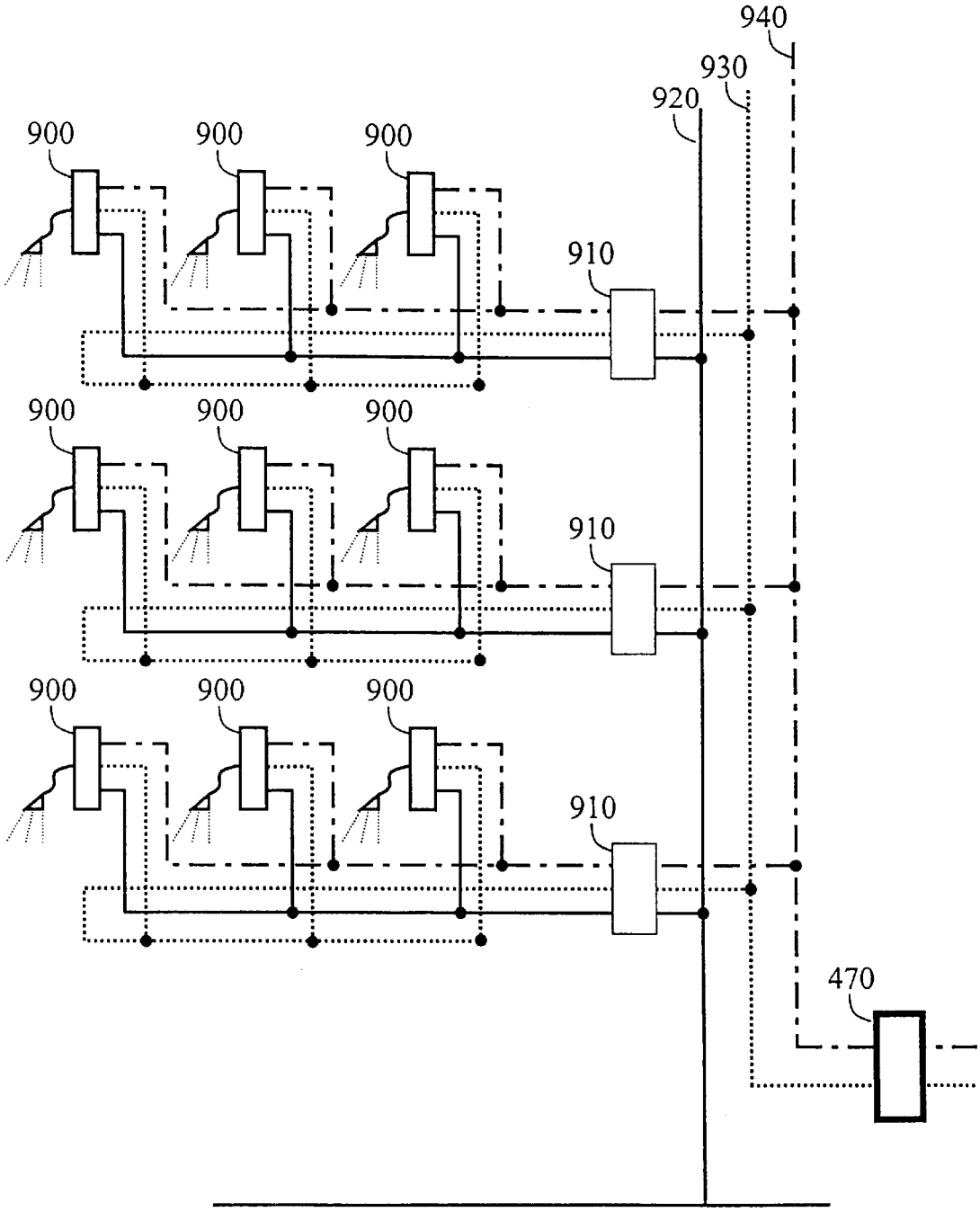
FIG. 9 is a schematic view of a water supply system in accordance with the present invention.

In FIG. 9 an exemplary tap water network according to the invention is schematically illustrated. The network comprises one pipe for hot water 940, one return water pipe 930, one cold water pipe 920 which is branched off, via pressure controlled regulators 910 and fed to the individual tapping points 900. The return water pipes are arranged according to the well-known Tishelman coupling principles in order to achieve proper circulation. In comparison with the network of FIG. 4, it should be noted that (a) no cold water return pipes are needed and (b) no cooling device 460 is needed. The adjustments of all the individual adjustment valves 570 and 565, the regulators in 910 as well as other, in this description omitted, means necessary to control the flow and pressure in a water network are considered to be well-known for the skilled in the art.

By installing tapping points according to the invention at all tapping points both hot and cold water are kept under constant circulation in the entire water supply network irrespective of whether the tap points are open or closed. The risk of immovable water heating up or cooling down to the hazardous temperature region is significantly reduced. It should be noted that all tapping points, not only for e.g. shower faucets should be of the kind afforded by the invention in order to maintain the circulation of both hot and cold water in all parts of the water network.

The invention has been exemplified with embodiments describing water tapping points like shower/bath faucets, but should not be considered limited to such devices. Other applications e.g. dental units would equally well benefit from the invention. Of special importance would be to utilise the invention in equipment rarely used such as emergency showers and emergency eye showers.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A water tapping point comprising a hot water inlet; and a cold water inlet;

a hot water space; and a cold water space;

a mixing chamber;

a hot water outlet from the hot water space and a cold water outlet from the cold water space, characterised by passage means extending between the hot water outlet and the cold water outlet and provided with means for connection to a common return water pipe.

2. The water tapping point according to claim 1 characterised in that the hot water outlet from the hot water space being provided with a first adjustment valve and that the cold water outlet from the cold water space being provided with a second adjustment valve, said first and second adjustment valves controlling the flow of hot and cold return water, respectively.

3. The water tapping point according to claim 2 characterised in that the passage means extending between the hot water outlet and the cold water outlet;

the first adjustment valve; and the second adjustment valve are contained within a mixer housing.

4. The water tapping point according to claim 2 characterised in that the passage means extending between the hot water outlet and the cold water outlet;

the first adjustment valve; and the second adjustment valve being provided outside a mixer housing.

5. The water tapping point according to claim 2 characterised in that the passage means extending between the hot water outlet and the cold water outlet;

the first adjustment valve; and the second adjustment valve being provided within a wall support of a mixer housing.

6. The water tapping point according to claim 1 further comprising a pressure sensitive valve for evacuating the mixer chamber.

7. The water tapping point according to claim 6 characterised in that the pressure sensitive valve is arranged to evacuate the mixer chamber when the pressure in the mixing chamber falls below a predetermined value.

8. The water tapping point according to claim 1 further comprising:

a hot water inlet valve;

a cold water inlet valve; and a pressure sensitive valve for evacuating the mixer chamber, said pressure sensitive valve arranged to open when both the hot water inlet valve and the cold water inlet valve are in closed positions.

9. The water tapping point according to claim 1 further characterised in that the hot water inlet comprises the hot water space and the cold water inlet comprises the cold water space.

10. A tap water network comprising tapping points in accordance with claim 1, said network comprising a main hot water pipe, a plurality of hot water pipes branched off from the main hot water pipe, a main cold water pipe, a similar plurality of cold water pipes branched off from the main cold water pipe, each one of the branched off warm and cold water pipes being provided with a number of said tapping points, characterised by a main return water pipe to which a similar plurality of return water pipes are connected, said return pipes carrying a mixture of hot and cold water circulated through each of the tapping points.

11. A water tapping point comprising a hot water inlet; and a cold water inlet;

a hot water space; and a cold water space;

a mixing chamber;

a hot water outlet from the hot water space and a cold water outlet from the cold water space, providing a flow of hot return water from the hot water outlet and a flow of cold return water from the cold water outlet, characterised by that the flow of return water from the hot water outlet and the flow of return water from the cold water outlet being combined to a common flow of return water, said common flow of return water being arranged to flow in a common return water pipe.

* * * * *